US005419567A

United States Patent [19]

Orav

[11] Patent Number: 5,419,567

[45] Date of Patent: May 30, 1995

[54] ANTI-BOUNCE-BACK DART

[76] Inventor: Mihkel Orav, 740 E. 34th St., Eastlake, Ohio 44095

[21] Appl. No.: 2,632

[22] Filed: Jan. 11, 1993

Related U.S. Application Data

[63] Continuation-in-part of Ser. No. 874,967, Apr. 27, 1992, abandoned.

[51] Int. Cl.[6] ..... A63B 65/02
[52] U.S. Cl. ..... 273/420
[58] Field of Search ..... 273/416, 419, 420

[56] References Cited

FOREIGN PATENT DOCUMENTS 2224452 5/1990 United Kingdom ..... 273/419

*Primary Examiner*—Paul E. Shapiro
*Attorney, Agent, or Firm*—H. D. Gordon

[57] ABSTRACT

An improved anti-bounce-back game dart (10) is provided wherein the structure mounting the point section (22A-22G) to the body section (20A-20G) for relative axial and/or axial and rotational movement is located internally of the dart body at the rearward end (32) of the body section, preferably in an enlarged cavity (36A-36G) opening directly to rearward end of the body section and easily accessible by threaded removal of the flight section (24A-24G).

20 Claims, 6 Drawing Sheets

FIG. 2
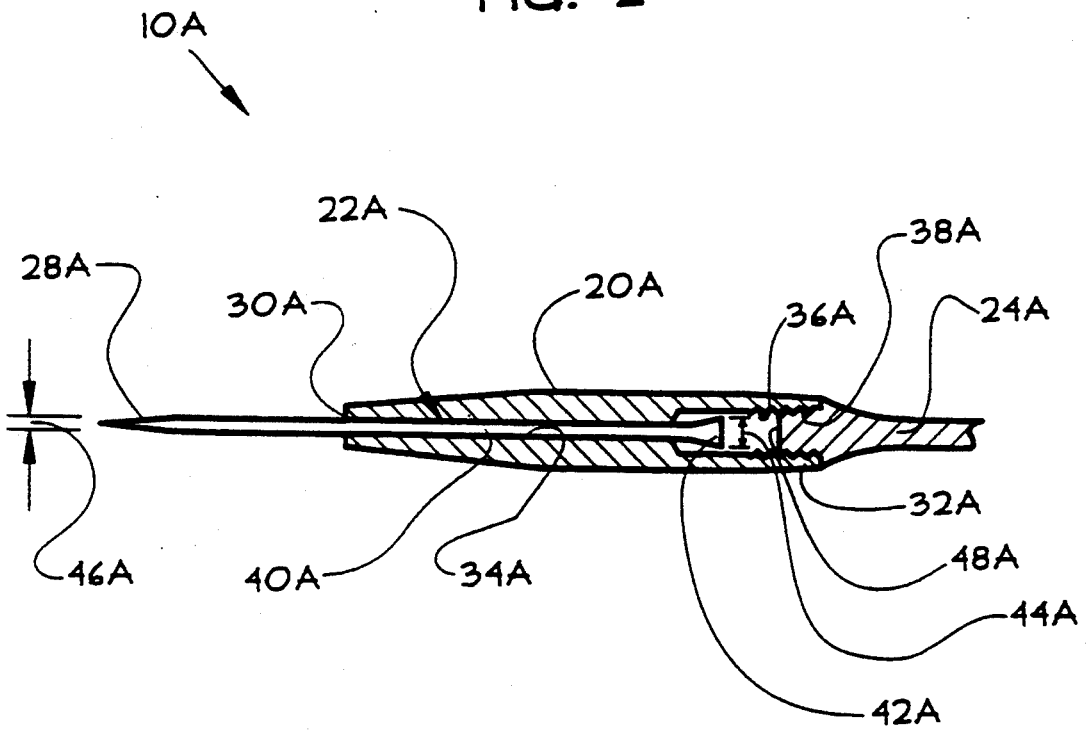
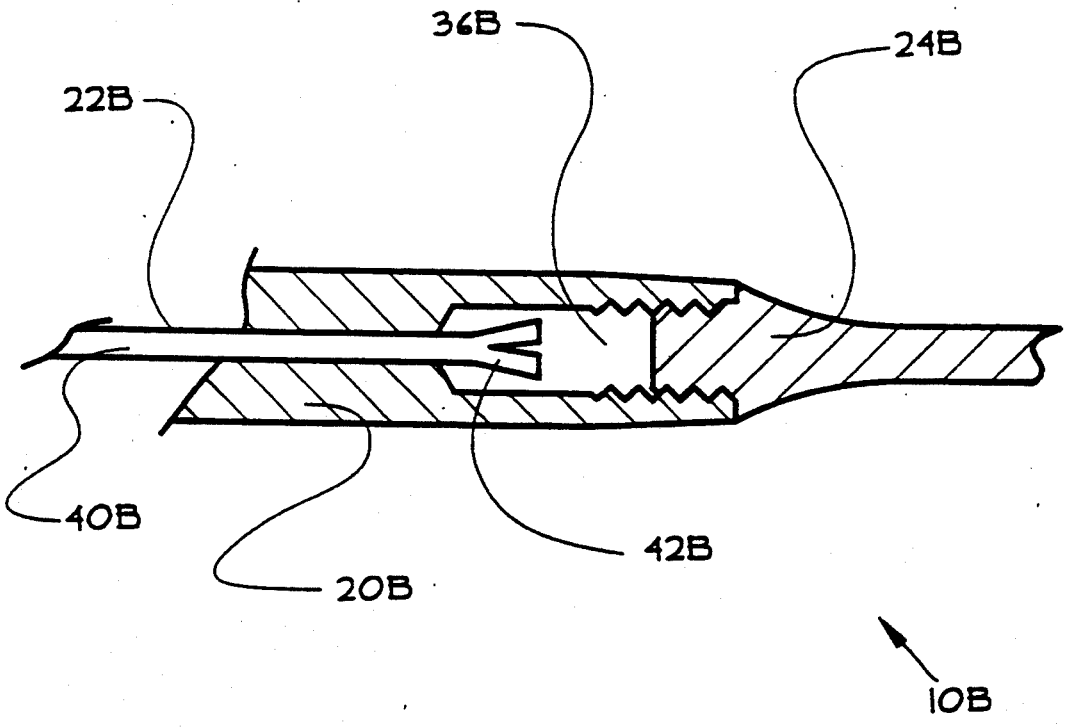
FIG. 3

FIG. 4
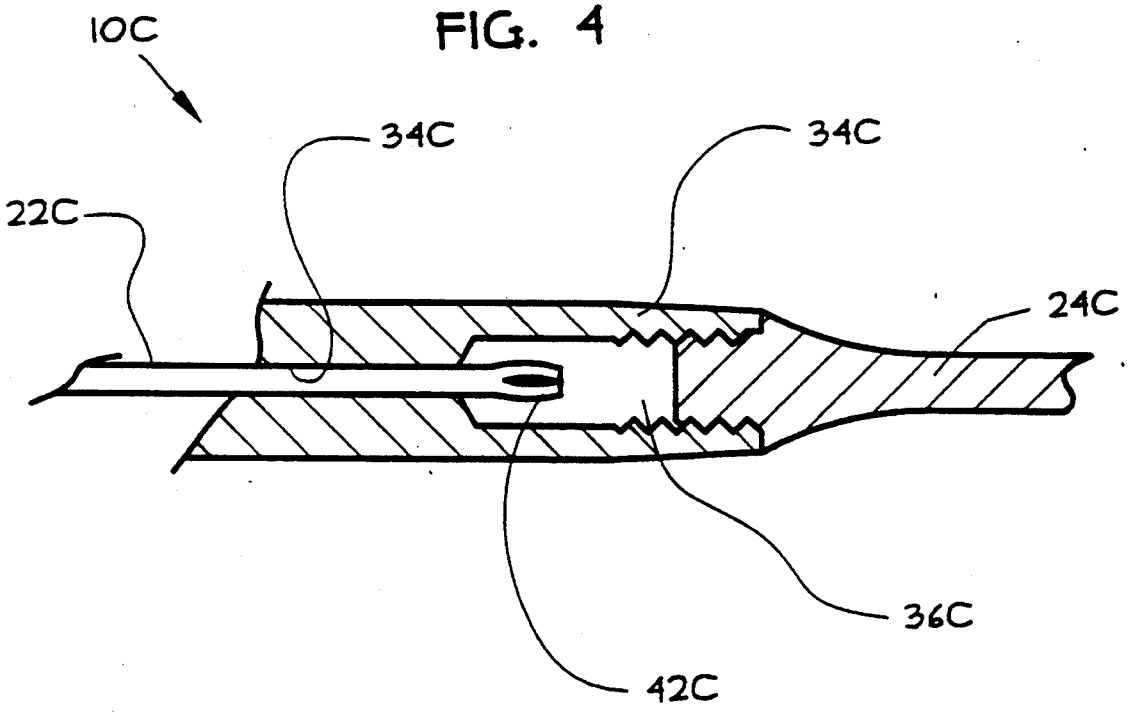
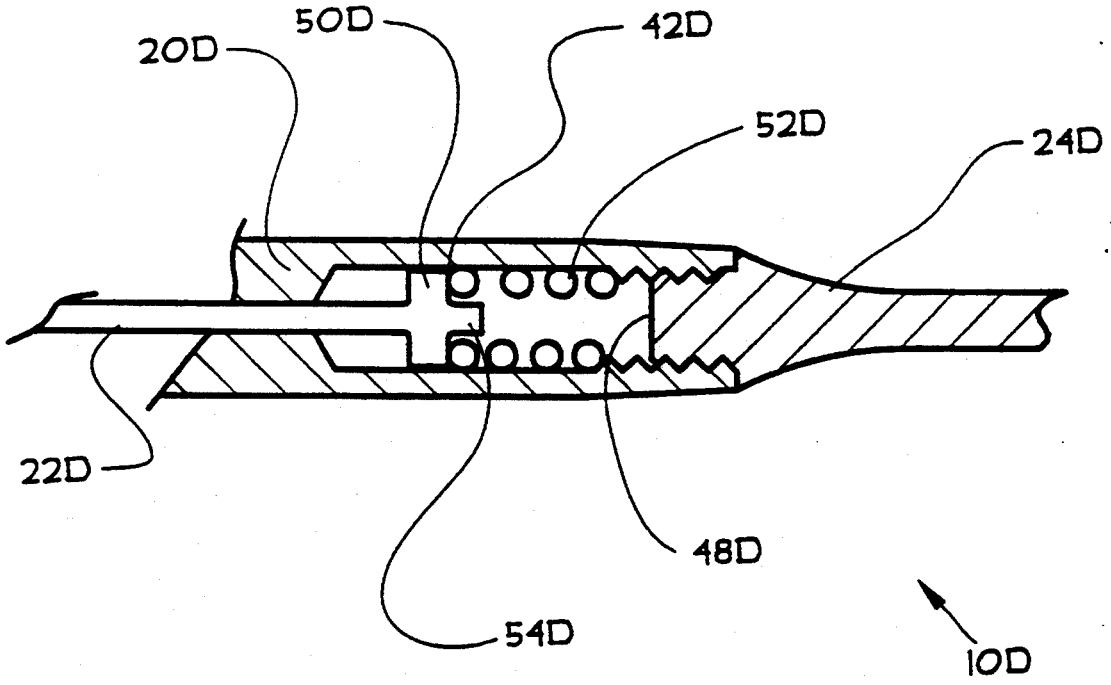
FIG. 5

FIG. 6
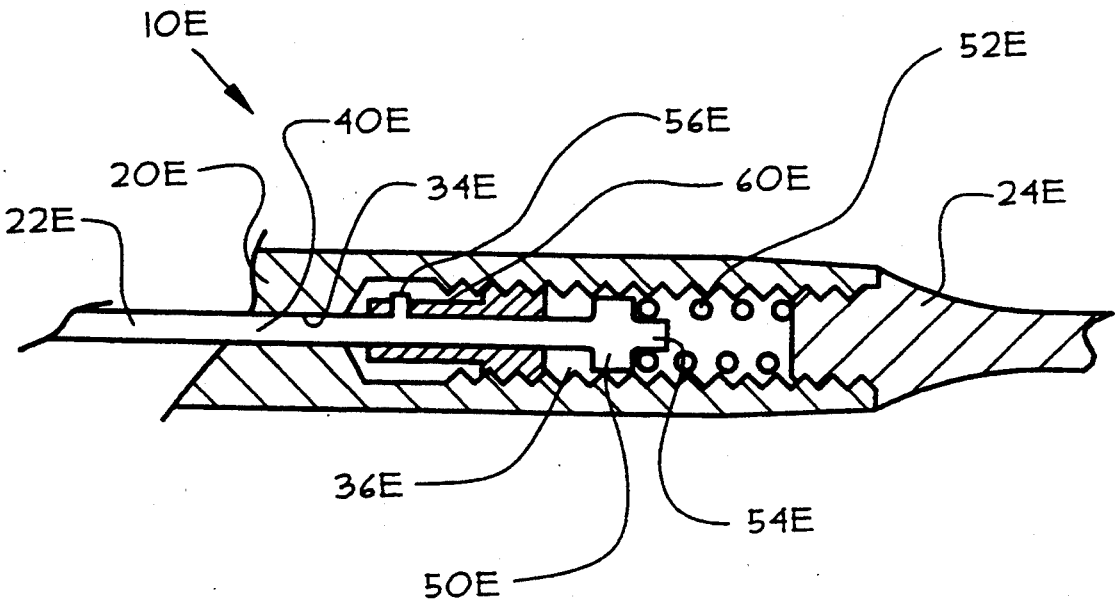
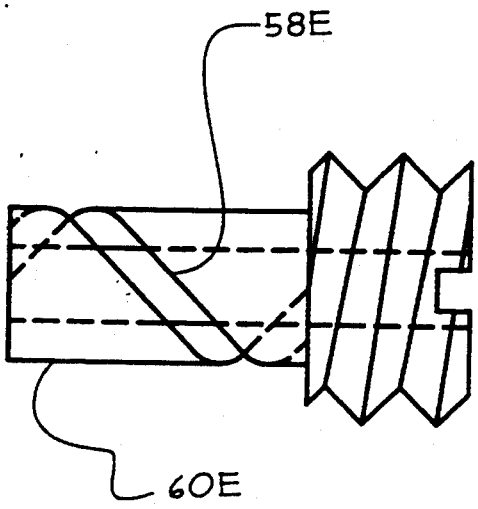
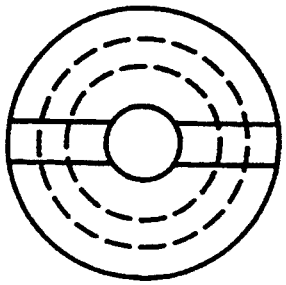
FIG. 6A
FIG. 6B

FIG. 7
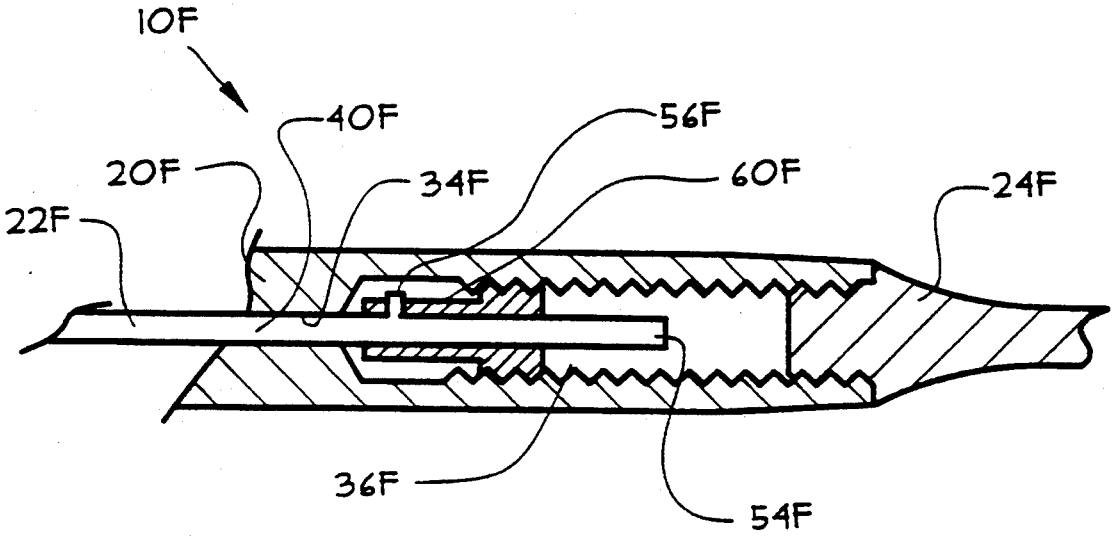
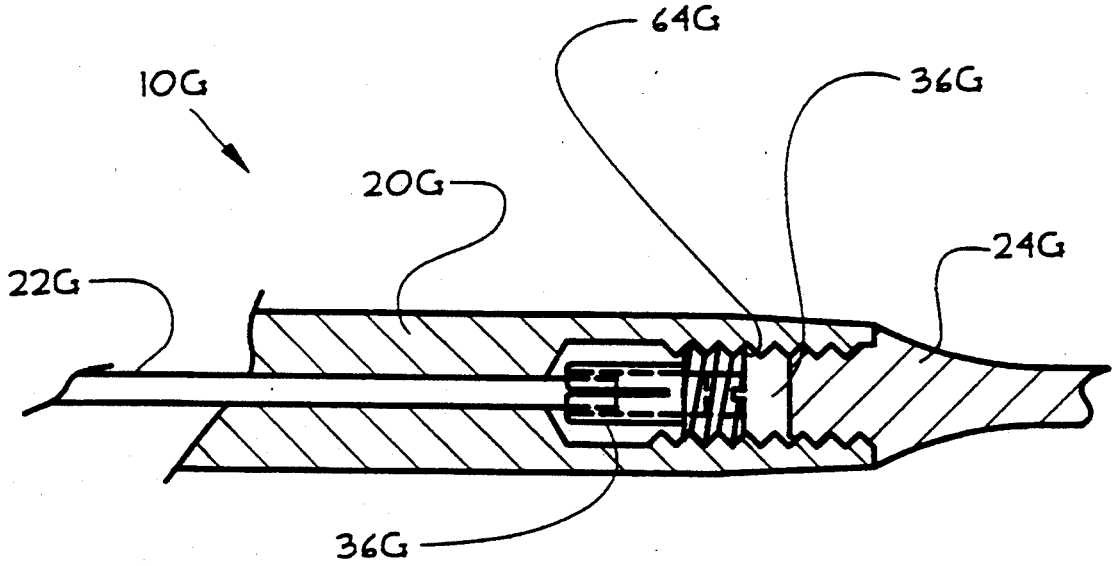
FIG. 8

ANTI-BOUNCE-BACK DART

BACKGROUND OF THE INVENTION

RELATED APPLICATIONS

This application is a continuation-in-part of application Ser. No. 07/874,967 filed Apr. 27, 1992, now abandoned.

FIELD OF THE INVENTION

This invention relates to game darts utilized with dart boards divided into sections by wires and particularly to game darts having means to minimize or eliminate the occurrence of dart bounce-back resulting from the tip of the point striking a wire or staple. More particularly, the present invention relates to anti-bounce-back game darts having a point section mounted for axial and/or axial and rotational movement relative to the body or barrel section wherein the mechanism mounting the point section to the body section is located internally of and adjacent the rearward end of the body section.

DESCRIPTION OF THE PRIOR ART

The game of darts is played throughout the world as a competitive contest. Many players are quite skilled in throwing a dart at a designated or desire location on a dartboard. The dartboards employed by serious players of the game incorporate a plurality of metal ribs to define target patterns for the board; and many games of darts require the participants to hit within predetermined target areas whose boundaries are defined by the metal ribs. As such, the ribs are fabricated from steel wire of a diameter between one or two or more millimeters. As will be described, the total area covered by these ribs is a considerable portion of the board area. Hence, players often times hit a metal rib with the dart point. This often causes the dart to bounce off the board and hence, the player receives no score. It is also determined that the better the player is, the more bounce-off he will experience due to the object and formats of various dart contests or games.

Various anti-bounce-off or anti-bounce-back game darts are known in the prior art. Previously, these include two general types of game darts, darts utilizing point sections axially movably mounted in the body sections as seen in U.S. Pat. Nos. 4,109,915; 4,181,303 and 4,230,322, the disclosures of which are incorporated herein by reference, and darts utilizing point sections resiliently pivotably mounted in body sections as seen in U.S. Pat. No. 4,101,126, the disclosure of which is incorporated herein by reference.

More recently, a third type of anti-bounce-back game darts utilizing point sections mounted for both axial and rotational simultaneous movement relative to the body sections were introduced. Anti-bounce-back game darts of this type are seen in U.S. Pat. Nos. 4,596,393 and 4,842,285, the disclosures of which are incorporated herein by reference.

The prior art anti-bounce-back game darts are generally improvements over game darts having fixed points, especially the prior art game darts wherein the point sections are mounted for simultaneous axial and rotational movement relative to the body sections thereof which are especially effective to eliminate or to minimize bounce-back to an acceptable level. However, the prior art devices were not totally satisfactory as the game darts were relatively complicated and/or expensive to manufacture and thus not suitable for the less expensive portion of the game dart market and/or the point sections were mounted to the body sections by mounting means located in enlarged cavities at the forward end or midsections of the body portions which required the game darts to have a relatively large outer diameter at the forward ends or midsections thereof thereby enlarging the area of the target or dart board not available for subsequently thrown darts and/or the relatively forwardly located cavity minimized front end weighting of the dart which may be helpful in minimizing undesirable pitching of the dart in flight.

The prior art anti-bounce-back game darts were also not totally satisfactory due to the fact that a relatively simple and inexpensive structure for adjusting the center of gravity thereof was not available.

SUMMARY OF THE INVENTION

In accordance with the present invention, the drawbacks of the prior art have been overcome, or minimized, by the provision of an anti-bounce-back game dart having a point section mounted for axial and/or axial and rotational movement relative to the body section by mounting means located internally of and adjacent the rearward end of the body section.

Further, a plurality of easily interchangeable point sections of differing lengths or weights may be provided to allow the dart thrower to quickly and simply adjust to the center of gravity of the dart.

The above is accomplished by providing a body section defining an elongated reduced constant diameter bore opening to the forward end of the body section and communicating with an enlarged diameter cavity at, and preferably opening to, the rearward end of the body, by providing the point section with an elongated shaft portion extending rearwardly from the point tip for slidable receipt in the elongated bore and by providing mounting means associated with the rearward end of the point section and with the inner walls of the cavity and/or rearward end of the cavity/bore intersection for limiting rearward and forward axial movement of the point section in the body section and, preferably, resiliently and/or releasably retaining the point section in its relatively forward axial position.

Preferably, the elongated bore will extend at least fifty percent, most preferably at least seventy percent, of the length of the body and thus the point section shaft's slidable receipt in the bore will provide sufficient stability of the point section in the body section to allow relatively simple and inexpensive mounting means to be utilized allowing a less expensive anti-bounce-back game dart product line to be provided when desired.

By not requiring an enlarged cavity at the forward end or midsection of the dart body section, the outer diameter of the forward end and/or midsection may be minimized and/or the weighting of the forward end and/or midsection increased, both of which may be desirable for both more sophisticated and less sophisticated types of anti-bounce-back game darts.

Preferably, the rearward end of the body section is closed by an easily attached and removed member allowing quick access to the rearward end of the enlarged cavity for quick installation and removal of interchangeable point sections for purposes of repair and/or center of gravity modification.

Accordingly, it is an object of the present invention to provide a new and improved anti-bounce-back game dart which allows less expensive manufacture, reduced diameter of the forward end and/or midsection and/or increased weighting of the forward end and/or midsection thereof.

These and other objects and advantages of the present inventions will become apparent from a reading of the description of the preferred embodiment of the present invention taken in connection with the attached drawings.

BRIEF DESCRIPTION OF THE DRAWINGS

FIG. 2 is an enlarged partial view in section of a first embodiment of the game dart of the present invention.

FIG. 3 is an enlarged partial view in section of a second embodiment of the game dart of the present invention.

FIG. 4 is an enlarged partial view in section of a third embodiment of the game dart of the present invention.

FIG. 5 is an enlarged partial view in section of a fourth embodiment of the game dart of the present invention.

FIGS. 6 and 6A–B are enlarged partial views in section of a fifth embodiment of the game dart of the present invention.

FIG. 7 is an enlarged partial view in section of a sixth embodiment of the game dart of the present invention.

FIG. 8 is an enlarged partial view in section of a seventh embodiment of the game dart of the present invention.

DESCRIPTION OF THE PREFERRED EMBODIMENT

In the following description of the preferred embodiment, certain terminology will be utilized for purposes of reference only and are not intended to be limiting. For example, the terms "forward" and "rearward" will refer to the direction in which a dart is normally thrown. The terms "inward", and "outward" will refer to directions towards and away from, respectively, the geometric center of the device being described. The above applies to the terms specifically mentioned above, derivations thereof and to words of similar import.

Figure 1:
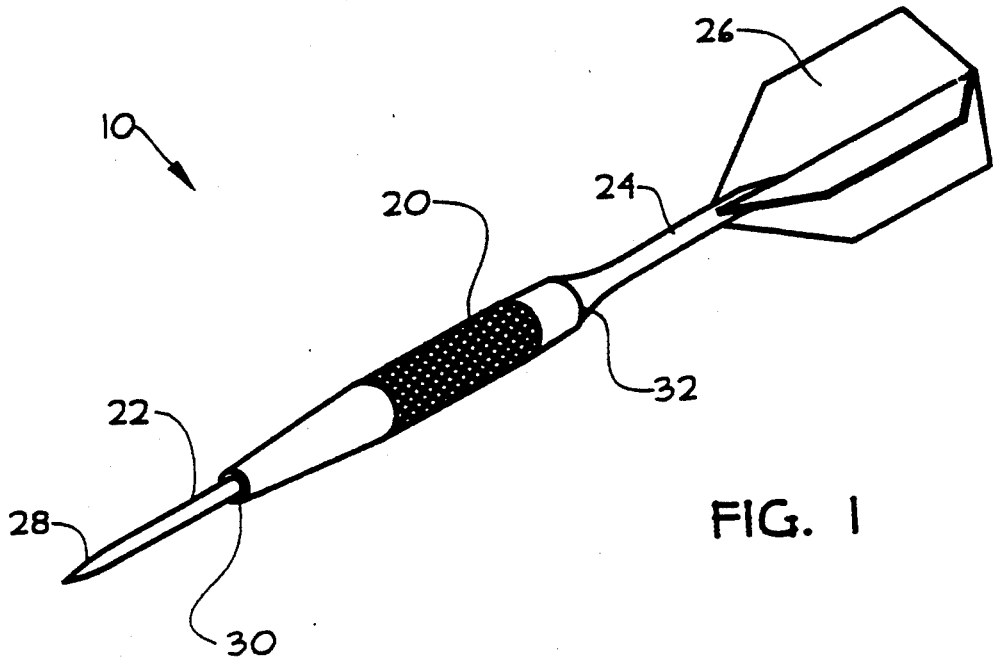
FIG. 1 is a perspective view of the game dart of the present invention.
Figure 1A:
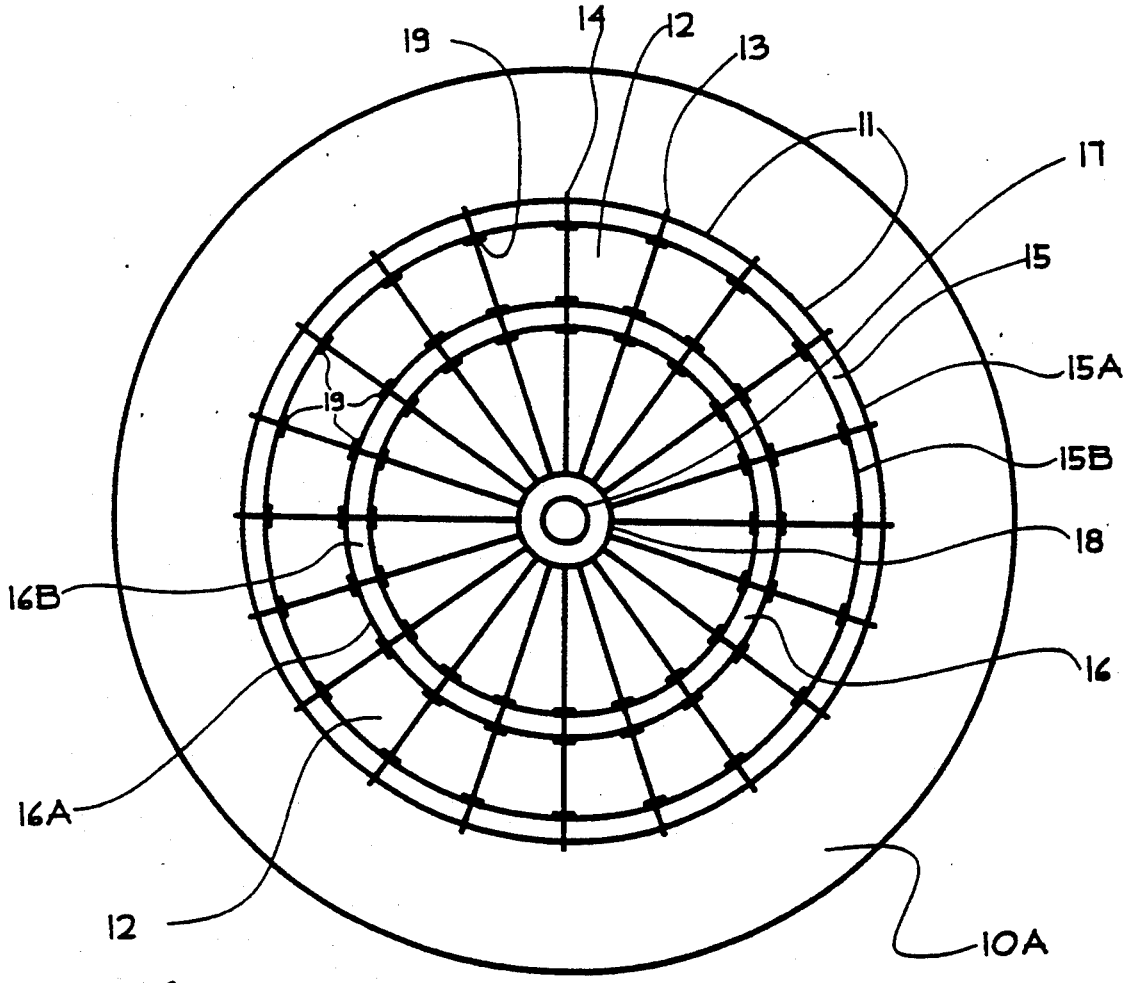
FIG. 1A is a front view of a typical dartboard.
Figure 10A:
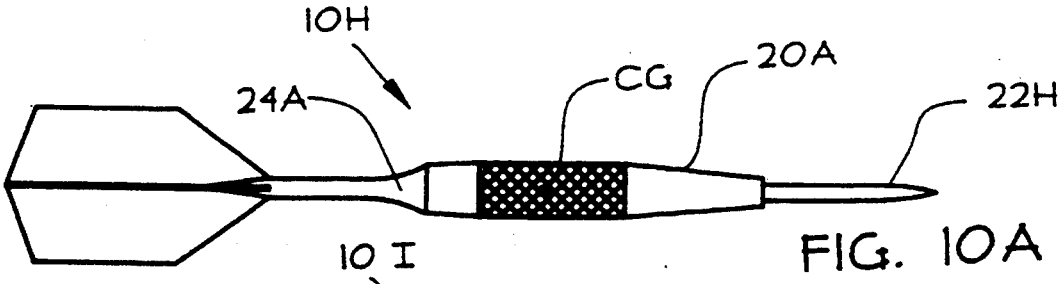
FIGS. 10A, 10B and 10C illustrate game darts using a common dart body section but the point sections of FIGS. 9A, 9B and 9C, respectively, to provide game darts having differing centers of gravity.
Figure 10B:
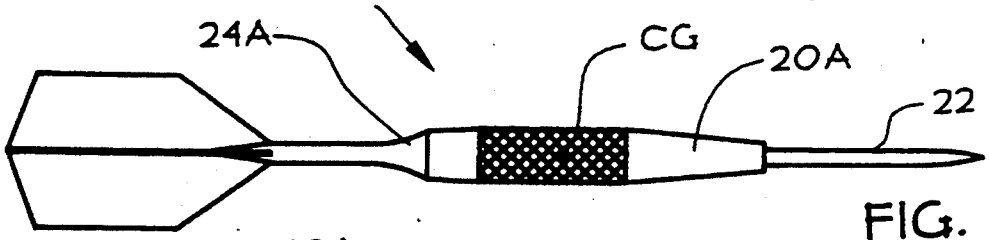
Figure 10C:
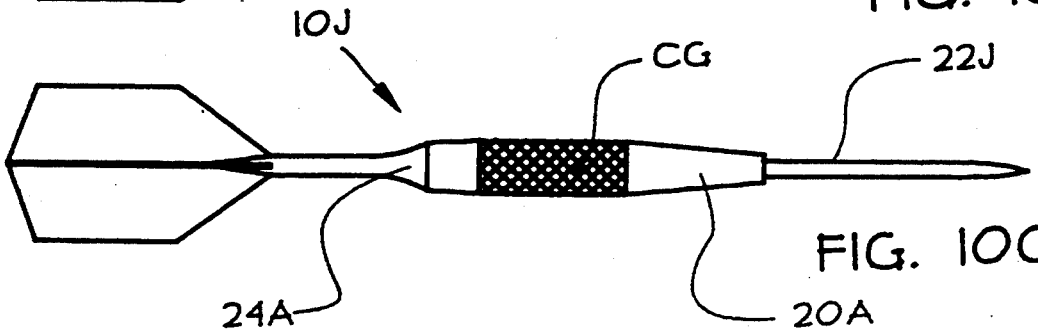

The game dart 10 of the present invention, and a typical dartboard 10A used therewith, are illustrated in FIGS. 1 and 1A, respectively.

Referring to FIG. 1A, there is shown a typical tournament type of dartboard 10A. Such boards as 10A are constructed from a penetrable material such as jute, cork and so on to permit a pointed dart to enter the board and be held in place by the board material. The operation of a dart and dartboard is considered to be well known. The dartboard 10A is usually about forty or more centimeters in diameter and has a plurality of metal wire ribs 11 defining target patters.

Essentially, the board 10A contains twenty equal pie-shaped areas as 12. Each area as 12 is bounded by two radial metal ribs as 13 and 14. Each rib 13 and 14 is approximately 1 to 2 or more millimeters in diameter and is fabricated from a steel wire of a circular cross-section. An outer ring area 15 is located about sixteen centimeters from the center of the boar. The outer ring area 15 is defined by an outermost metal rib 15A and an inner rib 15B. The distance between the ribs 15A and 15B is approximately one centimeter.

An inner ring area 16 is located about ten centimeters from the center and is defined by an outer ring 16A and an inner ring 16B. The distance between the rings 16A and 16B or the inner area 16 between the rings is also about one centimeter.

There is a central bulls-eye area 17 and a concentric area 18. Area 17 is about one and a half centimeters in diameter with area 18 about three and a half centimeters in diameter. The entire metal grid is held in place on the board 10A by a series of staples as 19 which are usually of the same material as the wire grids. It is thus indicated that in a board as 10A, the entire grid depicted is formed by steel wire of approximately 1 to 2 millimeters in diameter and a circular cross-section.

As can be ascertained, the wire grid depicted covers a reasonable portion of the board 10A. If a player, upon throwing a conventional dart, strikes a metal grid wire 11, the dart often bounces off and does not secure itself into the board 10A. For the bounce-off, the player receives no score. Furthermore, the point of the dart may be damaged by striking the metal grid wires.

The anti-bounce-back game dart 10 of the present invention includes a body or barrel section 20, a point section 22 extending axially from the body section 20 and a tail section 24 which carries the fight elements 26 which may be separable or integral with the tail section. The free end of point section 22 is provided with a tapered pointed tip 28 for penetration of a target such as dartboard 10A. The body section 20 defines a forward end 30 and a rearward end 32.

Game darts and dartboards of this general type, and the games played therewith, are well known in the prior art and may be appreciated by reference to above-mentioned U.S. Pat. Nos. 4,101,126; 4,109,915; 4,181,303; 4,230,322; 4,596,393 and 4,842,285, the disclosures of which are hereby incorporated by reference herein.

In the following description of the structural details of the various embodiments of the anti-bounce-back game dart of the present invention, elements having similar or identical structures and functions will be assigned like reference numerals with an appropriate letter appended thereto.

A first embodiment 10A of the anti-bounce-back game dart of the present invention may be seen by reference to FIG. 2. Typically, the body section 20A is a machined metallic part, often of stainless steel or a powdered metal alloy of tungsten and nickel, and has a forward end 30A and a rearward end 32A. The point section 22A has a tipped portion 28A which extends axially outwardly from the forward end 30A of the body section 20A and the tail section 24A extends axially rearwardly from the rearward end 32A of the body section.

The body section 20A defines an elongated substantially constant diameter bore 34A which opens to the forward end 30A of the body section and communicates with an enlarged diameter cavity 36A at the rearward end 32A of the body section. Preferably, the enlarged diameter cavity 36A opens to the rear of the body section and carries internal threads 38A for removable attachment of the tail piece 24A.

The point section 22A includes an elongated shaft section 40A extending rearwardly from the sharpened tip 28A and freely slidable in bore 34A. The rearward end 42A of the point section shaft is flared radially outward to define an outer diameter 44A greater than the inner diameter 46A of bore 34A.

The outwardly flared portion 42A of the point section is of a generally conical shape and will interact with the intersection of bore 34A and cavity 36A to (i) limit forward axial movement of the point section 22A relative to the body section 20A and (ii) to resiliently or releasably retain the point section in its axially forward position relative to the body section as illustrated in FIG. 2. The outwardly flared portion 42A may be provided with a grooved or knurled surface to increase the retention of the point section in the axially forward position thereof.

The forward end 37A of cavity 36A at the intersection of cavity 36A and bore 34A is preferably also rearwardly and outwardly flared for interaction with the outwardly flared portion 42A of the point section.

Rearward axial movement of the point section is limited by the forward wall or surface 48A of the tailpiece 24A. Rearward movement of the point section into contact with surface 48A will have the "hammering" effect described in above-mentioned U.S. Pat. No. 4,230,322.

The substantial length of bore 34A in which the shaft portion 40A of point section 22A is received (at least 50%, preferably at least 70%, of the axial length of body section 20A) provides substantial stability for the point section in the body section and allows the relatively simple and inexpensive structure of the anti-bounce-back dart 10A illustrated in FIG. 2.

A second embodiment 10B of anti-bounce-back game dart according to the present invention is illustrated in FIG. 3. The structure and function of game dart 10B is substantially identical to that of game dart 10A described above except that the flared rearward end 42B of point section 22B is slit to enhance the resilient retention of the point section in its relatively forward position.

A third embodiment 10C of the anti-bounce-back game dart of the present invention is illustrated in FIG. 4. This embodiment 10C is structurally and functionally identical to embodiments 10A and 10B described above except that the rearward end 42C of the point section 22C is swaged to provide radially outwardly extending projections for cooperation with the intersection of bore 34C and cavity 36C to retain the point section 22C in its axially forward position relative to the body section 20C.

Of course, other combinations and permutations of the rearward end of the point section may be provided for resiliently/releasably retaining the point section in its axially forward position.

Figure 9A:
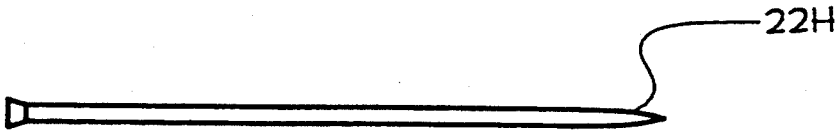
FIGS. 9A, 9B and 9C illustrate dart point sections of variable length and weight.
Figure 9B:
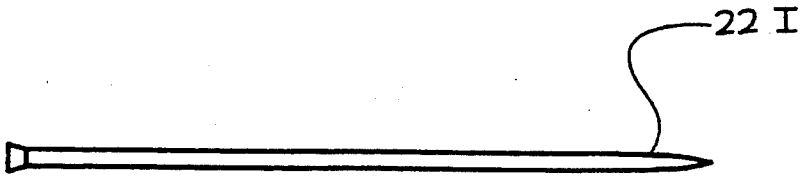
Figure 9C:
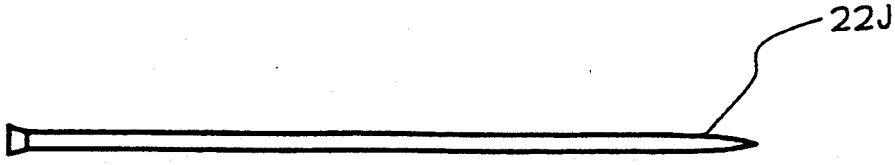

A fourth embodiment 10D of the present invention is illustrated in FIG. 5. In the anti-bounce-back dart 10D, the point section 22D is provided with a radially outwardly extending flange 50D at its rearward end 42D which will limit forward movement of the point section 22D in the body section 20D. The flange 50D also functions as spring seat for a compression spring 52D which is received between the forward surface 48D of the tailpiece 24D and the flange for resiliently biasing the point section 22D forwardly in body section 20D. A rearward extension 54D of the shaft of the point section may be provided to act as a spring guide and as a stop member for contacting the forward surface 48D. The function of game dart 10D may be appreciated in greater detail by reference to above-mentioned U.S. Pat. No. 4,109,915, FIG. 9 and U.S. Pat. No. 4,181,303.

A fifth embodiment 10E of the anti-bounce-back game dart of the present invention may been seen by reference to FIG. 6. In game dart 10E, a flange 50E and compression spring 52E are provided to bias the point section 22E forwardly in body section 20E as in game dart 10D described above. Additionally, the shaft 40E of the point section 22E is provided with a radially outwardly extending pin member 56E for cooperation with a helical groove 58E provided in a sleeve 60E provided in enlarged cavity 36E. FIG. 6A is a prospective view of sleeve 60E. Accordingly, upon impact with a surface, the point section will be forced axially rearwardly and will be simultaneously rotated.

The operation and advantages of an anti-bounce-back dart wherein the point is mounted for simultaneous axial and rotational movement relative to the body section may be appreciated in greater detail by reference to above-mentioned U.S. Pat. Nos. 4,596,393 and 4,842,285.

A sixth embodiment 10F of the anti-bounce-back game dart of the present invention may be seen by reference to FIG. 7. Game dart 10F is similar to the game dart 10E described above except that the biasing spring and spring seat flange utilized in game dart 10E is not utilized The anti-bounce-back functional operation and advantages of game dart 10F are similar or identical to above-mentioned U.S. Pat. No. 4,596,393.

A seventh embodiment 10G of the present invention may be seen by reference to FIG. 8. Anti-bounce-back game dart 10G utilizes a point section 22G having at its rearward end a member 62G which will remain is constant sliding frictional engagement with the inner surface 64G of enlarged cavity 36G as the point section 22G moves from its forwardmost to its rearwardmost axial position in body section 20G. The function, operation and several alternate embodiments for member 62G, may be seen by reference to above-mentioned U.S. Pat. No. 4,230,322.

The above alternate embodiments, 10A to 10G, of the present invention are presented for illustration only and are not intended to be limiting. The present invention is applicable to many alternate and rearranged means in anti-bounce-back game darts for mounting point sections (22, 22A-22G) to body sections (20, 20A-20G) for relative axial and/or axial and rotational movement therebetween.

A further alternate embodiment of the present invention may be seen by reference to FIGS. 9A-9C and FIGS. 10A-10C. The game darts of FIGS. 9A-9C and FIGS. 10A-10C are structurally and functionally substantially identical to the game dart 10A illustrated in FIG. 2.

A plurality of substantially identical, but differing length and thus differing weight, point sections 22H, 22I and 22J are provided for assembly to a common body section 20A to provide game darts 10H, 10I and 10J, respectively, of differing centers of gravity (CG). Of course, a similar result may be obtained by using point sections of equal length but of different weight materials.

As the structure of the game darts of the present invention allows assembly and removal of the point sections by simply threadably removing and then reattaching the tail sections 24 from and to the body section 22 to allow access to the cavity and the point sections, replacement/interchange of point sections for repair and/or center of gravity modification is quickly, simply and inexpensively accomplished.

I claim:

1. An anti-bounce-back game dart (10, 10A-10G) comprising (i) a body section (20, 20A-20G) defining a forward end (30,30A-30G) and a rearward end (32, 32A-32G), (ii) a point section (22, 22A-22G) having a pointed tip (28) extending axially outwardly from the forward end of said body section and axially movable in said body section from a first axially forward position (FIGS. 2-8) to a second axially rearward position, (iii) a flight section (24, 24A-24G) mounted to said body section and (iv) mounting means (42A-42C) associated with said point section and said body section for limiting relative axial movement therebetween and effective to releasably retain said point section in the axially forward position thereof:

said point section including an elongated substantially constant diameter shaft portion (40A) extending axially rearwardly from said tip to an enlarged cross-section rear end portion (42A-42C); and said body section defining an elongated substantially constant diameter (44A) bore (34A-34G) opening to the forward end (30) of said body section for slidable receipt of said shaft portion and an enlarged cavity (36A-36G) of greater diameter than said bore and coaxial with and intersecting said bore, said enlarged cavity receiving said rear end portion of said point section and opening directly to the rearward end (32) of said body section, said bore (34A-34G) extending at least fifty percent (50%) of the axial length of the body section, said rear end portion of said point section having a cross-section exceeding the diameter of said bore to limit forward axial movement of said point section in said body section, said game dart characterized by:

said mounting means is located substantially entirely within said cavity and is defined by an outer surface of said rear end portion of said point section adapted for resilient deformation interaction with at least one of the inner surfaces of said bore and said cavity adjacent the intersection thereof for releasably retaining said point section in the axially forward position thereof.

2. The game dart of claim 1 wherein said bore extends for greater than seventy percent (70%) of the axial length of the body section.

3. The game dart of claim 2 wherein said cavity carries threads (38A) for cooperation with threads carried by said flight section for threadably mounting said flight section to said body section.

4. The game dart of claim 3 wherein said flight section (24A) defines a forward wall (48A) for contact with the rear end portion (42A) of said point section (22A) to limit rearward axial movement of said point section in said body section.

5. The game dart of claim 4 wherein said enlarged cross-section rear end portion (42A-42C) defines a radially outwardly and axially rearwardly flared outer surface for resiliently deformable interaction with a similarly flared inner surface defined by at least one of said bore and said cavity adjacent the intersection thereof.

6. The game dart of claim 1 wherein said cavity carries threads (38A) for cooperation with threads carried by said flight section for threadably mounting said flight section to said body section.

7. The game dart of claim 6 wherein said flight section (24A) defines a forward wall (48A) for contact with the rear end portion (42A) of said point section (22A) to limit rearward axial movement of said point section in said body section.

8. The game dart of claim 7 wherein said enlarged cross-section rear end portion (42A-42C) defines a radially outwardly and axially rearwardly flared outer surface for resiliently deformable interaction with a similarly flared inner surface defined by at least one of said bore and said cavity adjacent the intersection thereof.

9. The game dart of claim 7 wherein said outer surface of said enlarged cross-section rear end portion (42A-42C) is radially outwardly and axially rearwardly flared for resilient deformable interaction with a similarly flared inner surface (37A) defined by at least one of said bore and said cavity adjacent the intersection thereof.

10. The game dart of claim 1 wherein said outer surface of said enlarged cross-section rear end portion (42A-42C) is radially outwardly and axially rearwardly flared.

11. The game dart of claim 1 wherein said outer surface of said enlarged cross-section rear end portion (42A-42C) is radially outwardly and axially rearwardly flared for resilient deformable interaction with a similarly flared inner surface (37A) defined by at least one of said bore and said cavity adjacent the intersection thereof.

12. An anti-bounce-back game dart (10, 10A-10G) comprising (i) a body section (20, 20A-20G) defining a forward end (30, 30A-30G) and a rearward end (32, 32A-32G), (ii) a point section (22, 22A-22G) having a pointed tip (28) extending axially outwardly from the forward end of said body section and axially movable in said body section from a first axially forward position (FIGS. 2-8) to a second axially rearward position, (iii) a flight section (24, 24A-24G) mounted to said body section and (iv) mounting means (41A-42C, 50D/54D, 56E/58E, 56F/58F, 62G/64G) associated with said point section and body section for mounting said point section to said body section and for limiting forward and rearward axial movement of said point section relative to said body section, said game dart characterized by:

said point section includes an elongated substantially constant diameter shaft portion (40A) extending axially rearwardly from said tip and said body section defines an elongated substantially constant diameter (44A) bore (34A-34G) opening to the forward end (30) of said body section for slidable receipt of said shaft portion and an enlarged cavity (36A-36G) of greater diameter than said bore and coaxial with and intersecting said bore, said bore extending at least fifty percent (50%) the axial length of said body section, said enlarged cavity opening directly to the rearward end (32) of said body section, said mounting means located substantially entirely within said cavity and said cavity carries threads (38A) for cooperation with threads carried by said flight section for threadably mounting said flight section to said body section.

13. The game darn of claim 12 wherein said flight section (24A) defines a forward wall (48A) for contact with the rearward end (42A) of said point section (22A) to limit rearward axial movement of said point section in said body section.

14. The game dart of claim 13 wherein said bore (34A-34G) extends at least seventy percent (70%) of the axial length of the body section.

15. A kit for providing an anti-bounce-back dart (10H, 10I, 10J) having a selectively variable center of gravity (CG), said kit comprising (i) a common body section (20A) defining a forward end (30A) and a rearward end (32A), (ii) a plurality of point sections (22H, 22I, 22J) each having a pointed tip (28) adapted to extend axially outwardly from the forward end of said body section and axially movable in said body section from a first axially forward position (FIGS. 2–8) to a second axially rearward position, (iii) a common flight section (24A) mounted to said body section and (iv) mounting means associated with said point sections and said common body section for limiting forward and rearward axial movement of said point sections relative to said body section, said game dart characterized by:

each of said point sections of a different weight and including an elongated substantially constant diameter shaft portion (40A) extending axially rearwardly from said tip and said body section defines an elongated substantially constant diameter (44A) bore (34A) opening to the forward end (30) of said body section and extending at least fifty percent (50%) of the axial length of said body section for slidable receipt of said shaft portions and an enlarged cavity (36A-36G) of greater diameter than said bore opening directly to the rearward end (32) of the body section and coaxial with and intersecting said bore, said mounting means located substantially entirely within said cavity, and said cavity carries threads (38A) for cooperation with threads carried by said flight section for threadably mounting said flight section to said body section.

16. The kit of claim 15 wherein each of said point sections (22H, 22I, 22J) are of different axial lengths.

17. The kit of claim 16 wherein said bore (34A) extends at least seventy percent (70%) of the axial length of the body section.

18. The kit of claim 15 wherein said bore (34A) extends at least seventy percent (70%) of the axial length of the body section.

19. The game dart of claim 15 wherein said mounting means comprises an enlarged cross-section rear end portion on each point section, and each said enlarged cross-section rear end portion (42A-42C) defines a radially outwardly and axially rearwardly flared outer surface for resiliently deformable interaction with a similarly flared inner surface defined by at least one of said bore and said cavity adjacent the intersection thereof.

20. The kit of claim 15 wherein each game dart assembly (10H, 10I, 10J) of common body section (20A), common flight section (24) and different weight point section (22H, 22I, 22J) has a center gravity (CG) located at a different axial location along said body.

* * * * *